US006626317B2

(12) United States Patent
Pfiefer et al.

(10) Patent No.: US 6,626,317 B2
(45) Date of Patent: Sep. 30, 2003

(54) OPENING DEVICE FOR A GARBAGE CAN HAVING TWO HINGED LID SEGMENTS

(75) Inventors: Rudolf Pfiefer, Mudersbach (DE); Gerhard Muller, Burbach-Luzeln (DE); Ernst Friedrich Weller, Sinn (DE)

(73) Assignee: Hailo-Werk Rudolf Loh GmbH & Co. KG, Haiger (DE)

( * ) Notice: Subject to any disclaimer, the term of this patent is extended or adjusted under 35 U.S.C. 154(b) by 69 days.

(21) Appl. No.: 09/791,957

(22) Filed: Feb. 23, 2001

(65) Prior Publication Data

US 2001/0020619 A1 Sep. 13, 2001

(30) Foreign Application Priority Data

Mar. 10, 2000 (DE) ..... 100 11 826

(51) Int. Cl.[7] ..... B65D 43/26
(52) U.S. Cl. ..... 220/263; 220/908; 220/826
(58) Field of Search ..... 220/262, 263, 220/264, 908, 810, 826, DIG. 13; 49/263

(56) References Cited

U.S. PATENT DOCUMENTS 1,170,797 A * 2/1916 Burroughs ..... 220/263
1,336,054 A * 4/1920 Searle ..... 49/265
1,481,922 A * 1/1924 Miller ..... 220/264
1,917,298 A * 7/1933 Hammer ..... 220/263
2,663,529 A * 12/1953 Lyttaker ..... 220/264
4,690,300 A * 9/1987 Woods ..... 220/264
4,892,218 A * 1/1990 Reiling ..... 220/263
4,964,523 A * 10/1990 Bieltvedt et al. ..... 220/254.2
5,170,904 A * 12/1992 Neuhaus ..... 220/262
5,207,344 A * 5/1993 Davies et al. ..... 220/23.83
5,292,023 A * 3/1994 Yen ..... 220/264
5,577,628 A * 11/1996 O'Neil et al. ..... 220/840
D410,124 S * 5/1999 Nilsson et al. ..... D34/1

* cited by examiner

*Primary Examiner*—Robin A. Hylton
(74) *Attorney, Agent, or Firm*—Hoffman, Wasson & Gitler, P.C

(57) ABSTRACT

A garbage can has a first lid segment hingedly attached to a first wall and a second lid segment hingedly attached to a second side wall. An actuator raises the lid segment from a closed position to an opened position. The actuator includes vertical rods attached to a foot pedal. Depression of the foot pedal causes the vertical rods to move upwardly and move the lid segments into the opened position. The first and second side walls meet a corner and a third arcuate side wall connects the first and second side wall to give the garbage can a sector shape.

9 Claims, 4 Drawing Sheets

OPENING DEVICE FOR A GARBAGE CAN HAVING TWO HINGED LID SEGMENTS

CLAIM OF PRIORITY

This application claims priority to German Patent Application Number 100 11 826.7 filed Mar. 10, 2000.

BACKGROUND OF INVENTION

1. Field of Invention

The present invention relates to a garbage can consisting of a container for holding garbage, including a lid which can be opened by pressing down a foot lever located in the front lower area of the garbage can.

2. The Background Art

Garbage cans of this type are sufficiently well known. Garbage cans of this type with an articulated lid that opens by means of a foot lever generally have a cylindrical casing with a corresponding cylindrical, and usually removable, container for garbage. Garbage cans of this type are also known which have an essentially square or rectangular outline. There has been a significant interest in recent times in so-called garbage separation into different garbage types, for example organic refuse (bio-trash), used paper, used glass, hazardous waste, residual waste, etc. This garbage separation should be performed by the consumer if possible, in the household where the garbage is created, in other words, for example, in the garbage can used in the kitchen area. Garbage cans have already become known for this purpose, which have several smaller removable inner containers inside of one casing, to hold different kinds of garbage. The garbage can itself, like the smaller inner containers, generally has an approximately rectangular shape. These conventional garbage cans have the disadvantage, however, that they do not allow for a convenient later expansion of the garbage holding capacity. It is true that, basically, a garbage can with a cylindrical casing could be placed next to another cylindrical garbage can of the same type. But this is quite disadvantageous from a space utilization standpoint, since the two casings do not form a continuous overall shape, and so space is wasted. The space availability, for example, in a lower kitchen cabinet is generally tight. In addition, in the case of free-standing garbage containers of this kind, the resulting appearance is not pleasing.

Known garbage cans with a lid that opens when a foot lever is pressed down also have the disadvantage that, due to the design, the lid opens in such a way that in its maximum opened position the lid is not quite vertical, but has an opening angle of less than 90 degrees. This does not create optimal conditions when garbage is tossed in. The maximum available cross section of the opening when viewed from above is partially covered by the lid which does not open to a true vertical or a 90 degree opening.

SUMMARY OF THE INVENTION

The purpose of the present invention is to create a garbage can which provides better availability of the garbage entry opening after the lid is opened.

The solution of this problem is provided by a garbage can according to the invention having a lid consisting of two wedge-shaped lid segments of about equal size, each of which has its own swing axis, and which swing upward like double-wing doors when the foot lever is pressed down, the entry opening in the middle area is nearly totally available after the opening of the lid, so that the garbage can be tossed in from nearly straight above the opening.

A further development of the solution according to the invention provides that the casing of the garbage can has a pie slice-shaped outline. Especially preferable is a quarter circle contour (outline) of the garbage can. The quarter circle contour has the advantage that two garbage cans of this type with the same design can be placed next to one another in order to obtain a half-circle contour. Three of these garbage cans can be placed next to one another, which then in the top view form a three-quarter circle, or else four garbage cans of this type, which make up a full circle (cylindrical casing). The individual garbage can with a quarter circle-shaped contour has two lid segments, each of which has a contour which is approximate eighth-circle shaped. The quarter circle contour shape allows, in particular, two or four of these garbage cans to be placed together with optimal use of space without any dead zones, while creating a garbage can ensemble with an aesthetically pleasing design.

Compared to a garbage can with several smaller inner containers, there is also a resulting greater flexibility when used for garbage separation. The user may at first use an existing garbage can for a single garbage type or use it without garbage separation. Then when he or she desires greater holding capacity or garbage separation, he or she can acquire a second garbage can of the same type and place these two garbage cans directly next to one another and then use them for different garbage types or for a greater garbage capacity. Likewise, a third or fourth garbage can of the same type offers further separation options, with four garbage cans making up a cylindrical overall arrangement but having a much greater garbage holding capacity than if one were to section a conventional cylindrical garbage can into several inner compartments using corresponding inner containers.

In a garbage can according to the invention, the mechanism for opening the lid segments includes a rod which is connected to the foot lever, with at least one vertically positioned bar for each lid segment, with the upper end of each bar being attached in an articulated manner with the bottom of the lid segment. Then when the foot lever is operated, the bars for all (preferably two) lid segments are raised synchronously and both lid segments are synchronously opened upward and outward around their external swing axes.

In order to improve the leverage ratios upon opening the lid segments, a further development of the invention provides that each bar is connected at its upper end in an articulated manner with a short lever arm, which in turn is connected rigidly with the lid segment. Meanwhile, the articulation point of the bar to the lever arm is preferably positioned at a distance from the swing axis of the lid segment. This results in a better power ratio in the opening of the lid segments. These power ratios can be further improved when, in a further development, the bar has a crimp in its upper end pointing inward away from the lid segment. Preferably the opening mechanism of the lid segments is designed in such a way that the essentially vertical bar which raises the lid segment does not merely move straight upwards but rather, in its upward movement, shifts a little to the side, especially in the upper area. Meanwhile, the bar is preferably guided within parts of the garbage can casing so as to be movable in a direction perpendicular to its lengthwise axis. In a construction design of the aforementioned type, this motion of the bar results from the fact that the swing axis of the lid segment is fixed, but the articulation point of the bar to the lever arm shifts in general in a curved motion during opening of the lid segment.

A further development of the invention provides for a damping device, by means of which the reverse motion (falling motion) of the bars and thus of the lid segments is braked after the release of the foot lever. In this way the lid segments can be prevented from making an unpleasant noise upon closing, after the foot lever is released. Such a damping device can include, for example, a spring mechanism or preferably a rack-and-pinion mechanism or equivalent gear elements.

In addition, at least one spring mechanism is preferably provided in the form of a recuperating spring or the like, in order to support the reverse motion (falling motion) of the bar after release of the foot lever. This is especially advantageous if the opened lid segments stand vertically or nearly vertically.

The features mentioned in the subclaims relate to further developments of the solution according to the invention. Further advantages of the invention are found in the following detailed description.

BRIEF DESCRIPTION OF THE DRAWINGS

The present invention is described in greater detail by referencing the accompanying drawings.

DETAILED DESCRIPTION

Those of ordinary skill in the art will realize that the following description of the present invention is illustrative only and not in any way limiting. Other embodiments of the invention will readily suggest themselves to such skilled persons.

Figure 1:
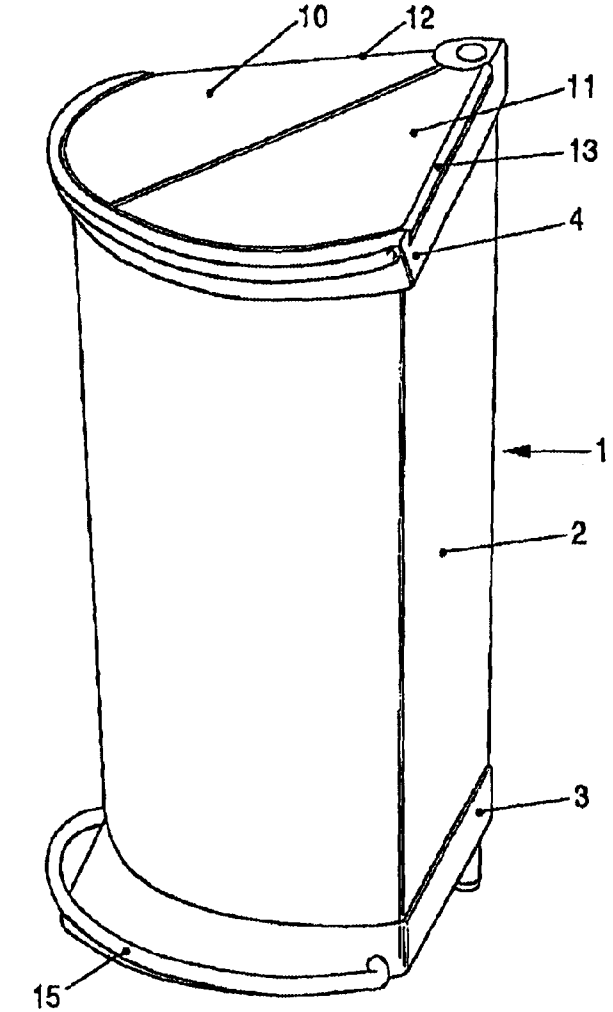
FIG. 1 shows a perspective overall view of a garbage can according to the invention.

Reference is made first to FIG. 1. In FIG. 1, the garbage can according to the invention is designated as a whole by (1). This garbage can (1) consists of a casing (2), which can be made, for example, of sheet metal and which, as can be seen, has a quarter circle-shaped contour. The casing has a lid consisting of two wedge-shaped lid segments (10, 11) of approximately the same size, each of which has an approximately eighth circle-shaped contour. Lid segments (10, 11) are opened by operating a foot lever (15) which is connected in an articulated manner via a rod, which is not depicted in FIG. 1, to the bottom of the two lid segments (10, 11), so that when foot lever (15) is pressed down, the two lid segments (10, 11) are raised and swing upward, each of them around its own external swing axis (12, 13), approximately like a double-winged door. Swing axes (12, 13) run approximately parallel to the external edge of garbage can (1). Casing (2) of the garbage can rests, on a pedestal (3), which can be made, for example, of plastic, and which frames the bottom of casing (2), which consists, for example, of sheet metal. Foot lever (15) has a partial circle-shaped ring shape and extends at both of its ends into pedestal (3). The partial ring-shaped foot lever (15), designed as a kind of pedal hoop, is positioned in a swinging manner in pedestal (3), around an axis, which runs in an approximately transverse manner through the garbage can. Moreover, the garbage can includes an upper part (4) which is preferably likewise made of plastic and on which the two lid segments (10, 11) rest in the closed position.

Figure 2:
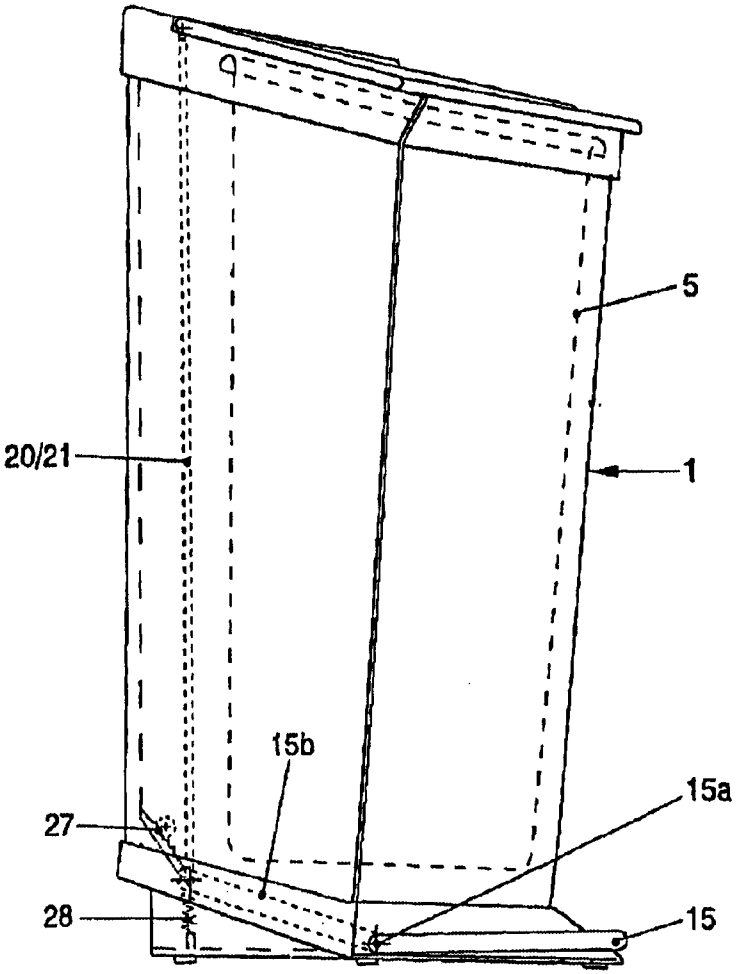
FIG. 2 shows a vertical cross section through the garbage can of FIG. 1.
Figure 4:
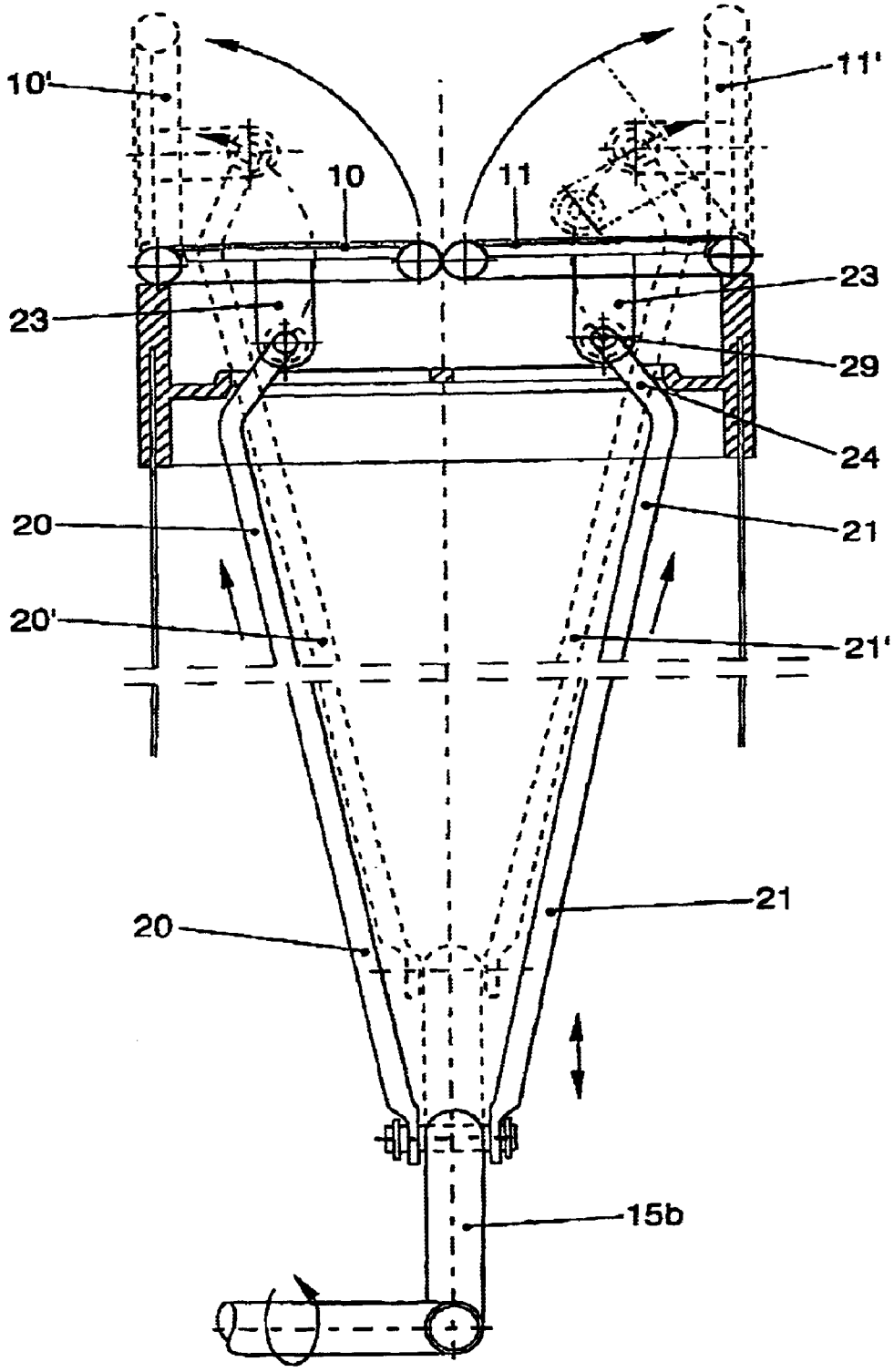
FIG. 4 shows a detailed view, which demonstrates the opening mechanism.

Reference is made to FIG. 2 for the following. The diagram shows garbage can (1) from the side. Here, swing axis (15*a*) of partial ring-shaped foot lever (15) can be seen, and a portion of the mechanism which serves to open lid segments (10, 11) is depicted. For this purpose, foot lever (15) is designed as a rod inside of garbage can (1) with an operating section (15*b*), the rear end of which is raised when foot lever (15) is pressed down. This operating section (15*b*) in turn is connected in an articulated manner with vertically positioned bars (20) and (21), which are lifted by the rear end of operating section (15*b*) when foot lever (15) is pressed down. Two such bars are provided, as can be seen in FIG. 4. The details of this rod will be explained later with more precision. One bar each, (20) and (21), are used to lift each of the two lid segments (10, 11). A recuperating spring 28) may be positioned in the lower area of the bar (20), and/or (21), which supports a reverse motion, that is, a falling motion of bar (20) or (21) after release of foot lever (15), so that lid segments (10, 11) can be better pulled out of the vertical position into a tipping position, from which they then automatically fall closed. In order to brake the fall of the lid segments, and thus to avoid an unpleasant noise upon closing, a damping device (27) is preferably also provided, by means of which the reverse motion of bars (20) and thus of lid segments (10, 11) after release of foot lever (15), is braked. This damping device (27) can include, for example, a rack-and-pinion mechanism, which is not explained further here. This damping device (27) is the object of another application by the applicant.

Container (5), which is used to hold the garbage, can also be seen in FIG. 2. This container (5) is a removable inner container.

Figure 3A:
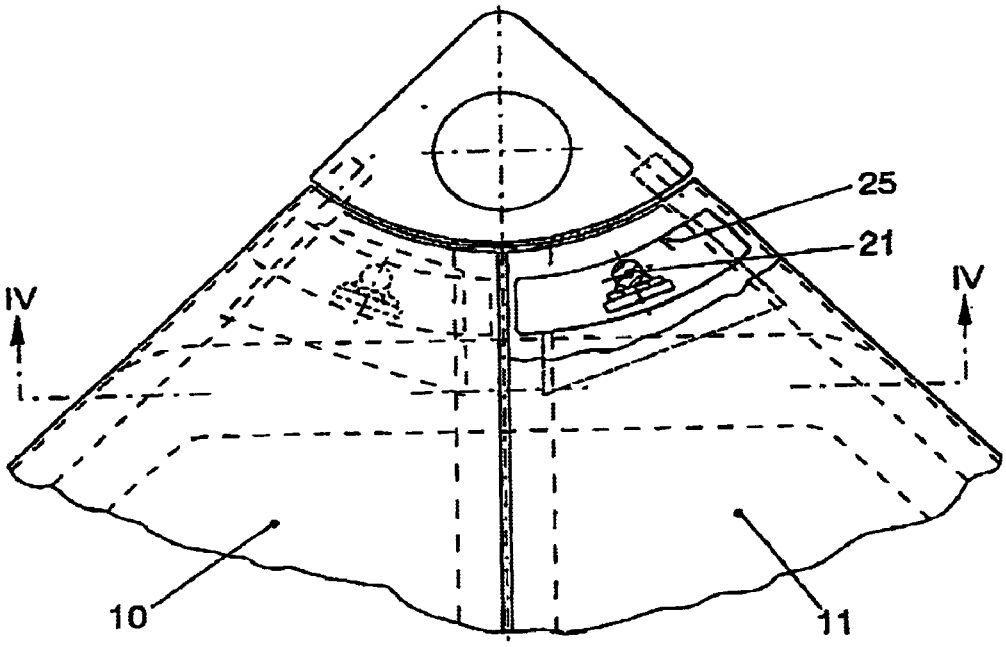
FIG. 3*a* shows a detailed view from the top in a first phase of motion.
Figure 3B:
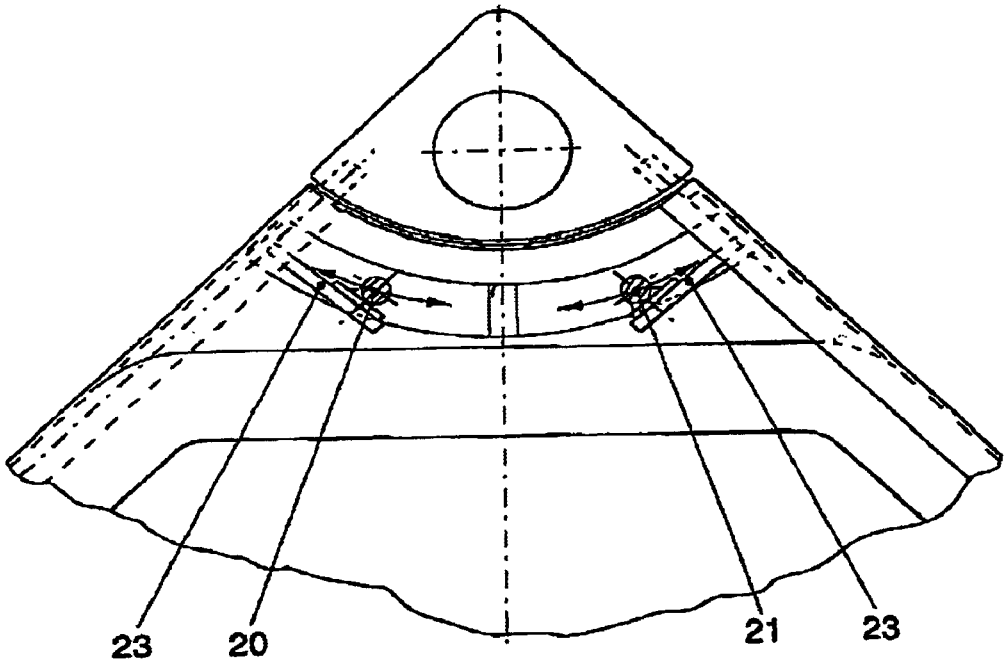
FIG. 3*b* shows a detailed view like FIG. 3*a*, but in a different phase of motion.

Details of the opening mechanism are now explained with greater precision by reference to FIGS. 3*a*, 3*b*, 4, 4*a*, and 4*b*. FIG. 3*a* shows a top view of the garbage can with lid segments (10, 11) closed, while on the other hand, in FIG. 3*b* the lid segments are opened so that the garbage entry opening of the garbage can is clear. The vertical bars (20, 21) for the lifting of lid segments (10, 11) can be seen in both diagrams, as well as recesses (25) in which bars (20, 21) are positioned so as to be movable in a direction perpendicular to their lengthwise axes during lifting of lid segments (10, 11). Namely, when lid segments (10, 11) are lifted, bars (20, 21) undergo a slight sideways shift, which is indicated in FIG. 3*b* by the arrows. This motion results from the conditions of articulation, because each of the upper ends of bars (20, 21) moves in a curved motion, as seen from the side, which will be explained in greater detail below. The right lid segment (11) is partially cut open in the rear area in FIG. 3*a*, so that vertical bar (21), which is depicted here in cross section, can be viewed directly. The entire view is simplified schematically for better clarity. In FIG. 3*b*, the two lid segments (10, 11) are opened so that each of the short lever arms (23) can be seen, to which the upper ends of each of the bars (20, 21) are connected in an articulated manner. The other ends of these short lever arms (23) are connected rigidly with the bottom of lid segments (10, 11).

The motion relationships during the opening of lid segments (10, 11) are explained visually using FIGS. 4*a* and 4*b*, to which reference is made in the following. In these figures, only the parts essential for explaining the invention are depicted. Bar (21) is shown, which is connected in an articulated manner to the short lever arm (23), which in turn is connected to lid segment (11). FIG. 4*b* shows the completely opened lid segment (11), which is in an approximately vertical position. In addition, external swing axis (13) can be seen, around which lid segment (11) swings in the opening motion. Moreover, it can be seen in FIG. 4*b* that bar (21) has a crimp in its upper end pointing inward at an obtuse angle away from the lid segment. The articulation axis between bar (21) and lever arm (23), that is, the upper articulation point of bar (21), is designated (29). In addition, the guide slot (25) shown already in FIG. 3*a* can be seen, within which bar (21) shifts in a transverse manner during the opening motion of lid segment (11).

Figure 4A:
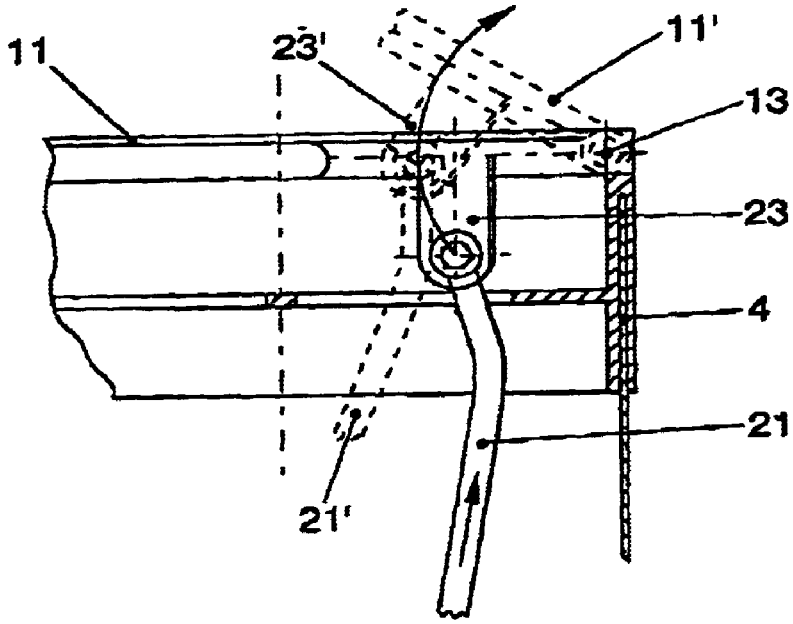
FIG. 4*a* shows a detailed view from the side in the phase of motion of FIG. 3*a;*
Figure 4B:
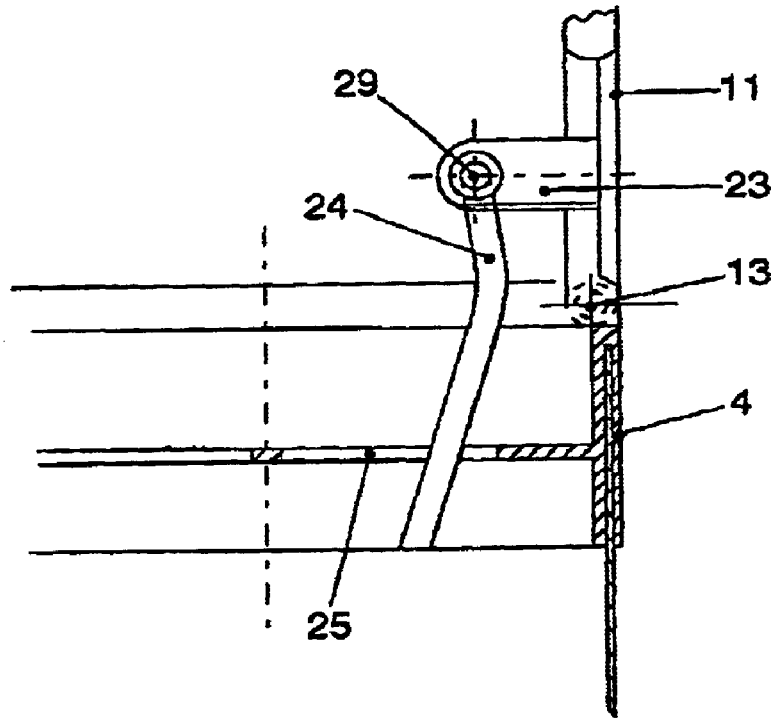
FIG. 4*b* shows a corresponding detailed view from the side in the phase of motion of FIG. 3*b*.

In FIG. 4*a*, two positions of lid segment (11) are shown, namely, on the one hand, the closed position in unbroken lines, and on the other hand, the approximately half-opened position in broken lines. It can be seen that lid segment (11, 11') swings around swing axis (13), and also the motion of bar (21) and of short lever arm (23) during the opening of lid segment (11, 11') is made clear. The parts are designated in the partially open position with (11'), (21') and (23'), respectively.

Reference is made in the following to FIG. 4. In this depiction, the influence of the motion of the two bars (20, 21) on the two lid segments (10, 11) is made clear. Unlike FIGS. 4*a* and 4*b*, in this case both bars (20, 21) are shown, both at their upper ends where they lift lid segments (10, 11) and at their lower ends, so that the foot lever rod's connection to operating section (15*b*) is seen. The diagram is likewise depicted in a schematically simplified manner. FIG. 4 shows the two bars (20, 21), on the one hand, in a lower position with unbroken lines, which corresponds to the closed position of the two lid segments (10, 11). The upward and downward motion of the bars (20, 21) upon operation of foot lever (15) is indicated with arrows. That end of operating section (15*b*), which points toward the rods, is lifted when the foot lever is pressed down, so that bars (20, 21) are pushed upward. Correspondingly, the respective upper ends of bars (20, 21) move upward and push the short lever arm (23) upward, so that then lid segments (10, 11) swing or flip upward around their external swing axes (13) like double-winged doors. The opened position of the lid segments is depicted by (10') and (11') in broken lines, as is the position of the two bars, which in the opened position are designated (20') and (21'). FIG. 4 also shows quite clearly that the articulation point (29) of bar (21) on lever arm (23) moves in a curved manner when lid segment (11) is opened. In addition, it can be seen in FIG. 4 that the respective crimps (24) in the upper ends of bars (20, 21) improve the leverage ratios during opening of the respective lid segments (10, 11). The lower ends of bars (20, 21) are connected with operating section (15*b*) in an articulated manner so as to swing around a horizontal axis (30). Operating section (15*b*) in turn is connected at its other end by means of a rod system, with multiple directional deviation, to partial ring-shaped foot lever (15) positioned outside the container, which was already explained above by reference to FIG. 2. Through this design it is possible to swing both lid segments (10, 11) synchronously upward to open the garbage can when foot lever (15) is pressed down (see FIG. 2).

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A garbage can, comprising a container, said container comprising a first wall having a top edge, and a second wall having a top edge, at least one wall extending between said first wall and said second wall, a first lid segment pivotally connected to the top edge of said first wall, a second lid segment pivotally connected to the top edge of said second wall, an actuator attached to both said first lid segment and said second lid segment for moving said lid segments from a closed position to an open position, said first wall and said second wall are connected at a corner.

2. The garbage can of claim 1, further comprising a foot lever attached to said actuator for moving said actuator.

3. The garbage can of claim 1, further comprising a first and second spring attached to said first and second lid segments respectively for biasing the lid segments to a closed position.

4. A garbage can, comprising a container, said container comprising a first wall having a top edge, and a second wall having a top edge, at least one wall extending between said first wall and said second wall, a first lid segment pivotally connected to the top edge of said first wall, a second lid segment pivotally connected to the top edge of said second wall, an actuator attached to both said first lid segment and said second lid segment for moving said lid segments from a closed position to an open position, said at least one wall is arcuate.

5. A garbage can, comprising a container, said container comprising a first wall having a top edge, and a second wall having a top edge, at least one wall extending between said first wall and said second wall, a first lid segment pivotally connected to the top edge of said first wall, a second lid segment pivotally connected to the top edge of said second wall, an actuator attached to said first lid segment and said second lid segment for moving said lid segments from a closed position to an open position, said actuator comprises a first vertical rod attached to said first lid segment and a second vertical rod connected to said second lid segment.

6. The garbage can of claim 5, further comprising a first and second short lever arm depending from said first and second lid segments, said first vertical rod attached to said first short lever arm, and said second vertical rod attached to said second short lever arm.

7. The garbage can of claim 5, further comprising guide slots for said first and second vertical rods.

8. The garbage can of claim 5, further comprising a foot lever connected to both said first and second vertical rods for moving said vertical rods upward.

9. The garbage can of claim 5, wherein the top of said first and second vertical rods is bent inwardly.

* * * * *